US006601587B2

(12) United States Patent
Shaw

(10) Patent No.: US 6,601,587 B2
(45) Date of Patent: Aug. 5, 2003

(54) TOENAIL CLIPPER EXTENSION DEVICE

(76) Inventor: Carlein Shaw, 284 Mallard St., Barnell, SC (US) 29812

( * ) Notice: Subject to any disclaimer, the term of this patent is extended or adjusted under 35 U.S.C. 154(b) by 0 days.

(21) Appl. No.: 09/991,813

(22) Filed: Nov. 19, 2001

(65) Prior Publication Data

US 2003/0094183 A1 May 22, 2003

(51) Int. Cl.[7] ..... A45D 29/18
(52) U.S. Cl. ..... 132/75.3
(58) Field of Search ..... 132/73.5, 75.4, 132/75.5; 30/26, 27, 28, 145, 341, 184

(56) References Cited

U.S. PATENT DOCUMENTS 857,790 A * 6/1907 Carroll ..... 30/28
4,847,994 A * 7/1989 Dunn, Jr. ..... 30/28
4,893,406 A * 1/1990 Larson ..... 30/28
5,357,677 A * 10/1994 West ..... 30/28

* cited by examiner

*Primary Examiner*—Todd E. Manahan
(74) *Attorney, Agent, or Firm*—Michael I. Kroll

(57) ABSTRACT

A toenail clipper extension device is provided with nail clippers attached to an elongated main extension that enables the user to perform the clipping task from a number of positions, included the upright seated position. A pistol grip handle is on the near end of the device, with a trigger, cord and dual rollers on the extension that cause the nail clipper lever to be pulled when the trigger is pulled. The user is assisted by a mirror and mirror extension arm assembly that provides 360 degree rotational and pivotal positioning of the mirror. Double ball joints are provided in this regard at the joinder of the mirror to the mirror extension arm, and the joinder of the mirror extension arm to the device main extension. The roller closest to the nail clipper assembly is specially sized and positioned within a compartmental enlargement of the main extension, such that the cord approaches the nail clipper lever at an acute angle in the static position. As the cord pulls the lever, the approach angle moves toward ninety degrees, thus providing an optimal approach angle for working the nail clipper lever.

28 Claims, 6 Drawing Sheets

TOENAIL CLIPPER EXTENSION DEVICE

BACKGROUND OF THE INVENTION

1. Field of the Invention

The present invention relates generally to nail clippers and, more specifically, to a trigger-activated extension device for toenail clippers which would enable overweight and other physically impaired people to cut their own toenails.

2. Description of the Prior Art

Numerous types of nail clippers have been provided in the prior art. For example, U.S. Pat. No. 4,176,449 issued to George K. C. Lee, et al. on Dec. 4, 1979 is illustrative of such prior art as is U.S. Pat. No. 4,564,034 issued on Jan. 14, 1986 Nathaniel T. Mackel. Sam Dunn Jr. was issued U.S. Pat. No. 4,846,994 on Jul. 18, 1989 and another patent was issued on Sep. 18, 1990 as U.S. Pat. No. 4,956,915 to Charles A. Anderson and yet another patent was issued to Justin w. West on Oct. 25, 1994 as U.S. Pat. 5,357,677. Still another patent was issued to David Rains as U.S. Pat. No. 5,775,340 on Jul. 7, 1998 and U.S. Pat. No. 5,926,956 was issued to Kirk Langmen et al. on Jul. 27, 1999. While these nail clippers may be suitable for the particular purpose to which they address, they would not be as suitable for the purposes of the present invention as heretofore described. While these toenail clippers may be suitable for the purposes for which they were designed, they would not be as suitable for the purposes of the present invention as heretofore described. It is thus desirable to provide a toenail clipper extension device having a trigger activated clipper assembly mounted on an extension rod which would allow physically restricted users to clip their own toenails without the assistance of others. An adjustable mirror assembly extending from the distal clipper end of the extension rod provides an alternate view of the clipper assembly to assist the user in accurately placing the clipper jaws on opposing sides of the toenail to be trimmed.

U.S. Pat. No. 4,176,449

Inventor: George K. C. Lee et al.

Issued: Dec. 4, 1979

This original invention, the GRIP-OPERATED NAIL CLIPPER, is a device improving the common (Finger-Operated) Toe-and-Finger Nail Clipper. The invention is the solution to the problem that less dexterous children, aged people, and arthritic and otherwise handicapped people have in manipulating and working the common finger-operated nail clipper. Its simple lever-clamp-like action puts the focus of grip-pressure closer and over the nail to be clipped making it easy to control, and the grip action of all five fingers and the palm is much stronger than the normal two-finger common nail clipper. Furthermore, the leverage is increased thus reducing considerably the force necessary to nip the nails clean. Unlike plier-like and other modes of nail clipper where the operating handgrip is opposite the fulcrum hinge and away from the nail being clipped, this invention device works in the direction toward the nail.

U.S. Pat. No. 4,564,034

Inventor: Nathaniel T. Mackel

Issued: Jan. 14, 1986

A holder permits a conventional nail clipper to be operated with only a downward press.of one finger or one toe, with the hand or foot having the nail to be cut resting on a common surface with the holder; a toenail can be cut without need to sit or to bend over if such would help a sufferer with arthritis or would speed up the nail cutting process, the clipper butt end instantly slips into a socket in the block-like base of the holder, and is as quickly removed; a portion of the clipper with the jaws protrudes upwardly and forwardly beyond the holder and the socket has an incline downwardly toward the rear that tips the jaws upward for safe visibility and for increasing the securance of the clipper in the socket under pressure of nail cutting.

U.S. Pat. No. 4,847,994

Inventor: Sam Dunn Jr.

Issued: Jul. 18, 1989

A remotely actuated toenail clipper includes a cylindrical tubular housing which encloses an axially reciprocating plunger rod. A leaf spring type toenail clipper extends through a slot in a bottom portion of the housing. An actuating lever of the toenail clipper is in engagement with the plunger rod. A scissor mechanism extends transversely through a slot in an upper portion of the housing for actuating the plunger rod. The device is particularly designed for use by individuals who have difficulty reaching their toenails with conventional forms of nail clippers. In a second embodiment, the axially movable plunger rod is electrically actuated by a solenoid mechanism. An adjustable telescope is mounted in parallel relation to the cylindrical housing and provides an individual with a clear view of the toenail clipper.

U.S. Pat. No. 4,956,915

Inventor: Charles A. Anderson

Issued: Sep. 18, 1990

A device for clipping fingernails and toenails which includes an enclosure having an open side facilitating insertion of a nail-carrying digital member, and having a nail clipper aperture therethrough on its opposite side from the open side. The enclosure has a transparent top panel having a portion configured as a magnifying lens. A retention element is secured to the inside of the enclosure at a location adjacent the nail clipper aperture. The nail clipper has a portion thereof carrying clipper jaws extended through the aperture into the enclosure, and there detachably engaged by the retainer element.

U.S. Pat. No. 5,775,340

Inventor: David Rains

Issued: Jul. 7, 1998

A new Long Handle Toenail Clipper for allowing a person to cut their toenail without needed to bend over. The inventive device includes a conventional nail clipper-having a cutting portion and an actuating lever. A triangular base is positioned below and is secured to a lower segment of the cutting portion. The triangular base orients the nail clipper with a forward end of the nail clipper disposed below a rearward end of the nail clipper. A telescopic handle is coupled to the actuating lever of the nail clipper.

U.S. Pat. No. 5,357,677

Inventor: Juston W. West

Issued: Oct. 25, 1994

A toenail clipper assembly has a nail clipper connected on one end of an elongated member and a pistol-type grip mounted on the other end. A cord attached to the nail clipper and a trigger adjacent to the handle actuates the clipper. The elongated member may have a pivotal joint near the clipper end of the elongated member to permit moving the clipper in an arc.

U.S. Pat. No. 5,926,956

Inventor: Kirk Langman et al.

Issued: Jul. 27, 1999

A combined toe and finger nail clipper having a common metal strip with a toe nail cutting edge at one end and a finger nail cutting edge at the opposite end. Mating nail cutting edges are at the ends of two additional metal strips which are each welded above and below at opposite ends of the common metal strip. A pair of vertical retaining posts located at each end of the nail clipping unit bold lever arms which can be stored in the flat position or rotated around and put into the use position as in conventional nail clippers. In this way a manufacturer can produce a combined toe and finger nail clipper more economically than two separate nail clippers and the user can store the combined nail clipper in a smaller space without worrying about locating two separate clippers. The clipper can be constructed so that while one of the clippers is in use the cutting edges of its other are closed or only slightly open so as to avoid the comers of the cutting edges catching or scratching a finger of the user.

A toenail clipper assembly has a nail clipper connected on one end of an elongated member and a pistol-type grip mounted on the other end. A cord attached to the nail clipper and a trigger adjacent to the handle actuates the clipper. The elongated member may have a pivotal joint near the clipper end of the elongated member to permit moving the clipper in an arc.

SUMMARY OF THE PRESENT INVENTION

The present invention relates generally to nail clippers and, more specifically, to a toenail clipper extension device including an extension rod having a trigger assembly on a first end and a nail clipper assembly on the second end.

A primary object of the present invention is to provide a toenail clipper extension device that will overcome the shortcomings of prior art devices.

Another object of the present invention is to provide a toenail clipper extension device that greatly reduce the degree of movement required by users to clip their own toenails.

Still another object of the present invention is to provide a toenail clipper extension device including an adjustable mirror assembly extending from the distal clipper end of the extension rod wherein said mirror assembly may be prepositioned by the user to provide a preferred view of the interaction between the clipper assembly and the toenail.

Yet another object of the present invention is to provide a toenail clipper extension device wherein the mirror assembly includes a magnifying mirror glass to provide the user with a more detailed view of the clipper assembly's interaction with the toenail.

Yet another object of the present invention is to provide a toenail clipper extension device wherein the mirror assembly includes an illumination means to increase the visibility of the clipper assembly and toenail area whether viewing directly or in the mirror.

A further object of the present invention is to provide a toenail clipper extension device wherein the lever and roller system delivers a greater degree of force to the lever of the clipper assembly than the user must exert upon the trigger therefore making the present invention easy to use and indispensable to those with weak or arthritic hands.

A still further object of the present invention is to provide a toenail clipper extension device wherein the trigger assembly is accompanied by a pistol grip handle to increase the ease of controlling the positioning of the present invention particularly during the substantially vertical placement of the clipper assembly to the toe area.

A yet further object of the present invention is to provide a toenail clipper extension device wherein the mirror assembly comprises a mirror plate pivotably and rotatably connected to a mirror extension shaft by means of a ball joint assembly with another ball joint assembly connecting the mirror assembly to the main extension rod thereby providing 360 degree axial rotation of the mirror assembly to the distal end of the main extension rod and the clipper assembly.

Still another object of the present invention is to provide a toenail clipper extension device that is simple and easy to use.

Yet another object of the present invention is provide a toenail clipper extension device that is economical in cost to manufacture.

Additional objects of the present invention will appear as the description proceeds.

The present invention comprises an extension rod having a first end-with toenail clippers fastened thereto at a right angle and a second end having a pistol grip and trigger mechanism attached thereon with a cord and roller system communicating therebetween. A magnifying mirror assembly located on the distal clipper end is provided to increase visibility of the toenails to be trimmed and the clipper assembly. An operator uses his or her direct line of sight and/or the view presented by the angle of the mirror as positioned by the operator to assure accurate placement of the toenail clippers relative to the toenail to be trimmed. The user then pulls the trigger mechanism, which influences the cord and roller system and depresses the lever of the clipper assembly resulting in the closing of the jaws of said clipper assembly, thereby effectively clipping the toenail.

The trimming of one's own toenails can be difficult or impossible for people who are obese, recently out of surgery, or have any other physical impairment that restricts movement. People in such cases often rely on family, friends or health care workers to perform such tasks. This dependency often results in a lack of self-esteem because of the additional burden that they feel is being placed upon others or in the task being neglected and therefore resulting in the growth of uncomfortably long toenails which could lead to further health problems including broken toenails, infection, fungus, etc. The present invention provides a toenail clipper extension device that will enable a user with restricted movement to comfortably clip his or her own toenails without the reliance of others thereby resulting in better self-esteem and hygiene.

A toenail clipping device is provided, comprising: an elongated body, the elongated body having a first end and a second end, the elongated body further having an enlargement proximate the elongated body second end; a pistol grip handle on the elongated body first end; a nail clipping assembly on the elongated body second end, having two spring members, joined together at first ends of the spring members and connected to the elongated body at the joined first ends, and having two cutting jaws biased apart on second ends of the spring members, and a lever for moving the two jaws together for cutting a nail; an actuating trigger connected to the elongated body by a pivotal connection proximate the pistol grip handle; and a cord extending over a first and second roller and connected between the trigger and the lever, the first roller being positioned proximate the actuating trigger, the second roller being positioned in the elongated body enlargement, the first and second roller being so positioned for moving the lever toward the two spring members, thus moving the two cutter jaws on the spring levers together when the trigger is rotated around the pivotal connection toward the pistol grip handle.

In one embodiment the foregoing device further comprises a mirror assembly, the, mirror assembly having a mirror and an extension arm, the mirror being movably attached to the extension arm, the extension arm being movably attached to the elongated body.

One embodiment of the foregoing device further comprises a hinge joint for attaching the extension arm to the mirror.

Another embodiment of the above device further comprises a ball joint for attaching the extension arm to the mirror.

Another embodiment of the above device further comprises a double ball joint for attaching the extension arm to the mirror.

Another embodiment of the above device further comprises a hinge joint for attaching the extension arm to the elongated body.

Another embodiment of the above device further comprises a ball joint for attaching the extension arm to the elongated body.

Another embodiment of the above device further comprises a double ball joint for attaching the extension arm to the elongated body.

Another embodiment of the above device further comprises a double ball joint for attaching the extension arm to the elongated body, and a double ball joint for attaching the extension arm to the mirror.

A toenail clipping device is provided comprising: an elongated body, the elongated body having a first end and a second end; a pistol grip handle on the elongated body first end; a nail clipping assembly on the elongated body second end, having two spring members, joined together at first ends of the spring members and connected to the elongated body at the joined first ends, and having two cutting jaws biased apart on second ends of the spring members, and a lever for moving the two jaws together for cutting a nail; an actuating trigger connected to the elongated body by a pivotal connection proximate the pistol grip handle; a cord connected between the trigger and the lever for moving the lever toward the two spring members, thus moving the two cutter jaws together when the trigger is rotated around the pivotal connection toward the pistol grip handle; and a mirror assembly, the mirror assembly having a mirror and an extension arm, the mirror being movably attached to the extension arm, the extension arm being movably attached to the elongated body.

One embodiment of the foregoing device further comprises a hinge joint for attaching the extension arm to the mirror.

Another embodiment of the above device further comprises a ball joint for attaching the extension arm to the mirror.

Another embodiment of the above device further comprises a double ball joint for attaching the extension arm to the mirror.

Another embodiment of the above device further comprises a hinge joint for attaching the extension arm to the elongated body.

Another embodiment of the above device further comprises a ball joint for attaching the extension arm to the elongated body.

Another embodiment of the above device further a double ball joint for attaching the extension arm to the elongated body.

Another embodiment of the above device further comprises a double ball joint for attaching the extension arm to the elongated body, and a double ball joint for attaching the extension arm to the mirror.

A toenail clipping device is provided comprising: an elongated body, the elongated body having a first end and a second end; a pistol grip handle on the elongated body first end; a nail clipping assembly on the elongated body second end, having two spring members, joined together at first ends of the spring members and connected to the elongated body at the joined first ends, and having two cutting jaws biased apart on second ends of the spring members, and a lever for moving the two jaws together for cutting a nail; an actuating trigger connected to the elongated body by a pivotal connection proximate the pistol grip handle; a cord extending over a pair of rollers and connected between the trigger and the lever, for moving the lever toward the two spring members, thus moving the two cutter jaws on the spring levers together when the trigger is rotated around the pivotal connection toward the pistol grip handle; and a mirror assembly, the mirror assembly having a mirror and an extension arm, the mirror being movably attached to the extension arm, the extension arm being movably attached to the elongated body.

One embodiment of the foregoing device further comprises a hinge joint for attaching the extension arm to the mirror.

Another embodiment of the above device further comprises a ball joint for attaching the extension arm to the mirror.

Another embodiment of the above device further comprises a double ball joint for attaching the extension arm to the mirror.

Another embodiment of the above device further comprises a hinge joint for attaching the extension arm to the elongated body.

Another embodiment of the above device further a ball joint for attaching the extension arm to the elongated body.

Another embodiment of the above device further comprises a double ball joint for attaching the extension arm to the elongated body.

Another embodiment of the above device further comprises a double ball joint for attaching the extension arm to the elongated body, and a double ball joint for attaching the extension arm to the mirror.

A toenail clipping device is provided comprising: an elongated body, the elongated body having a first end and a second end; a pistol grip handle on the elongated body first end; a lever; means for clipping nails in response to movement of the lever; an actuating trigger connected to the elongated body by a pivotal connection proximate the pistol grip handle; and means for moving the lever when the trigger is rotated around the pivotal connection toward the pistol grip handle.

One embodiment of the foregoing device further comprises a mirror and means for positioning the mirror for viewing the position and operation of the nail clipping assembly.

In one embodiment of the foregoing device the means for positioning the mirror provides rotatable and pivotable positioning.

A toenail clipping device is provided comprising: an elongated body, the elongated body having a first end and a second end; a pistol grip handle on the elongated body first end; a nail clipping assembly on the elongated body second end, having two spring members, joined together at first ends of the spring members and connected to the elongated body at the joined first ends, and having two cutting jaws biased apart on second ends of the spring members, and a lever for moving the two jaws together for cutting a nail; an actuating trigger connected to the elongated body by a pivotal connection proximate the pistol grip handle; means for moving the two cutter jaws on the spring levers together when the trigger is rotated around the pivotal connection toward the pistol grip handle; a mirror; and means for rotatably and pivotably positioning a mirror for viewing the position and operation of the nail clipping assembly.

A toenail clipping device is provided comprising: an elongated body, the elongated body having a first end and a second end, the elongated body further having an enlargement proximate the elongated body second end; a pistol grip handle on the elongated body first end; a nail clipping assembly on the elongated body second end, having two spring members, joined together at first ends of the spring members and connected to the elongated body at the joined first ends, and having two cutting jaws biased apart on second ends of the spring members, and a lever for moving the two jaws together for cutting a nail; an actuating trigger connected to the elongated body by a pivotal connection proximate the pistol grip handle; and a cord extending over a first and second roller and connected between the trigger and the lever, the first roller being positioned proximate the actuating trigger, the second roller being positioned proximate the nail clipping assembly, the first and second roller being so positioned for moving the lever toward the two spring members, thus moving the two cutter jaws on the spring levers together when the trigger is rotated around the pivotal connection toward the pistol grip handle, the second roller being further positioned and sized such that the cord and the lever form an acute angle prior to such movement of the lever.

One embodiment of the foregoing device further comprises a mirror assembly, the mirror assembly having a mirror and an extension arm, the mirror being movably attached to the extension arm, the extension arm being movably attached to the elongated body.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
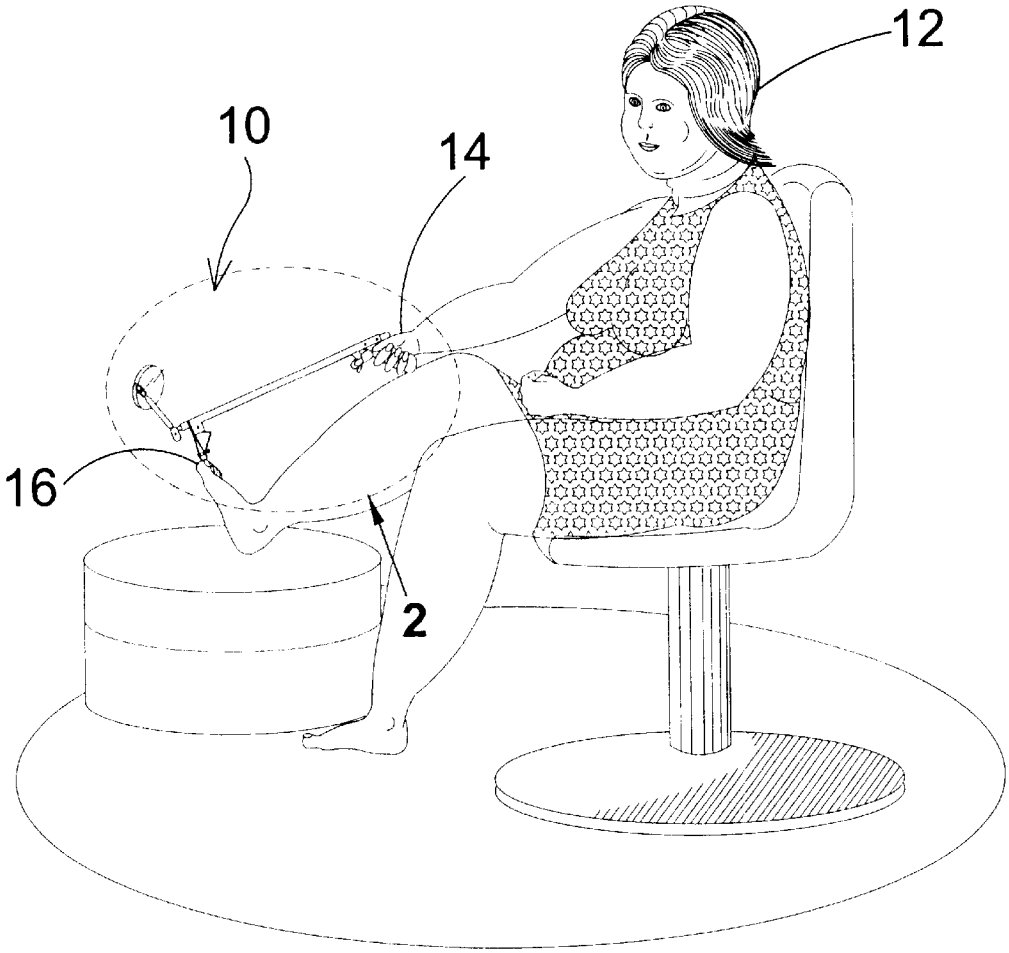
FIG. 1 is a perspective view of the present invention in use.

Turning now descriptively to the drawings, in which similar reference characters denote similar elements throughout the several views, the figures illustrate the embodiments of the toenail clipper extension device of the present invention. With regard to the reference numerals used, the following numbering is used throughout the various drawing figures.

10 toenail clipper extension device of the present invention
12 user
14 user's hand
16 user's toe
18 nail clipper assembly
20 nail clipper first spring member
22 nail clipper second spring member
24 nail clipper first cutting jaw
26 nail clipper second cutting jaw
28 nail clipper lever
30 main extension shaft
32 main extension shaft first end
34 main extension shaft second end
38 main extension shaft compartment
40 trigger mechanism
42 first roller
44 second roller
46 cord
50 mirror
52 mirror extension arm
54 first double ball joint
56 second double ball joint

DETAILED DESCRIPTION OF THE PREFERRED EMBODIMENTS

Turning now descriptively to the drawings, in which similar reference characters denote similar elements throughout the several views, FIGS. 1–6 illustrate the toenail clipper extension device of the present invention indicated generally by the numeral 10.

The device 10 is depicted to various extents in FIGS. 1–6, and in use in FIG. 1. As shown in FIG. 1, the device 10 is held by the user 12 in the hand 14 and appropriately positioned with respect to the user's toe 16.

Figure 2:
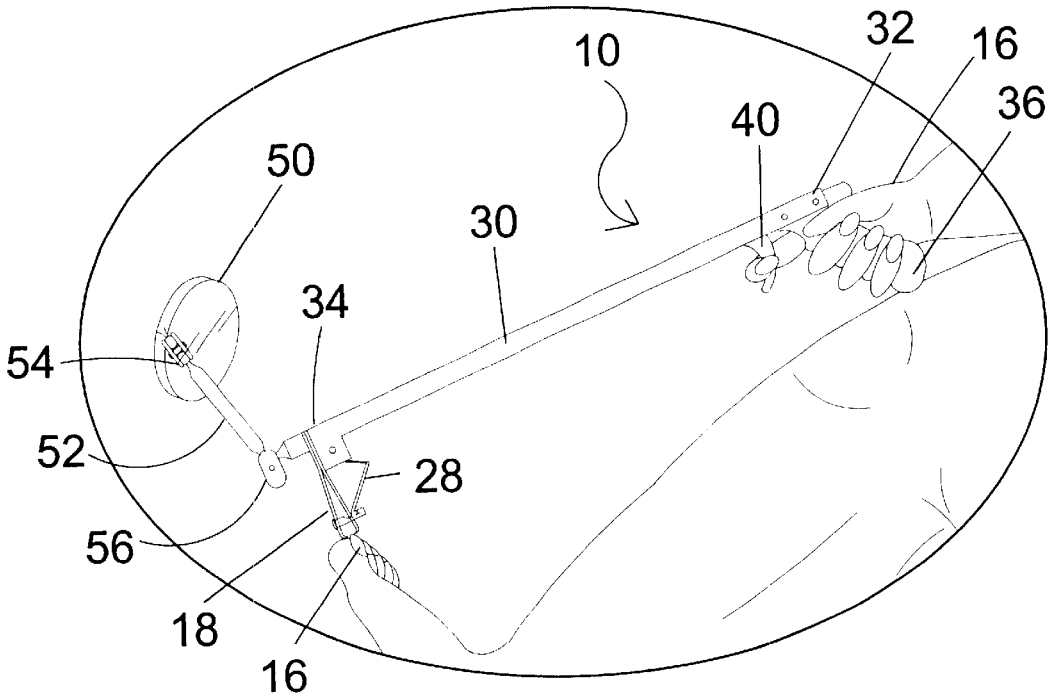
FIG. 2 is a closer view of the present invention taken from FIG. 1 as indicated.
Figure 3:
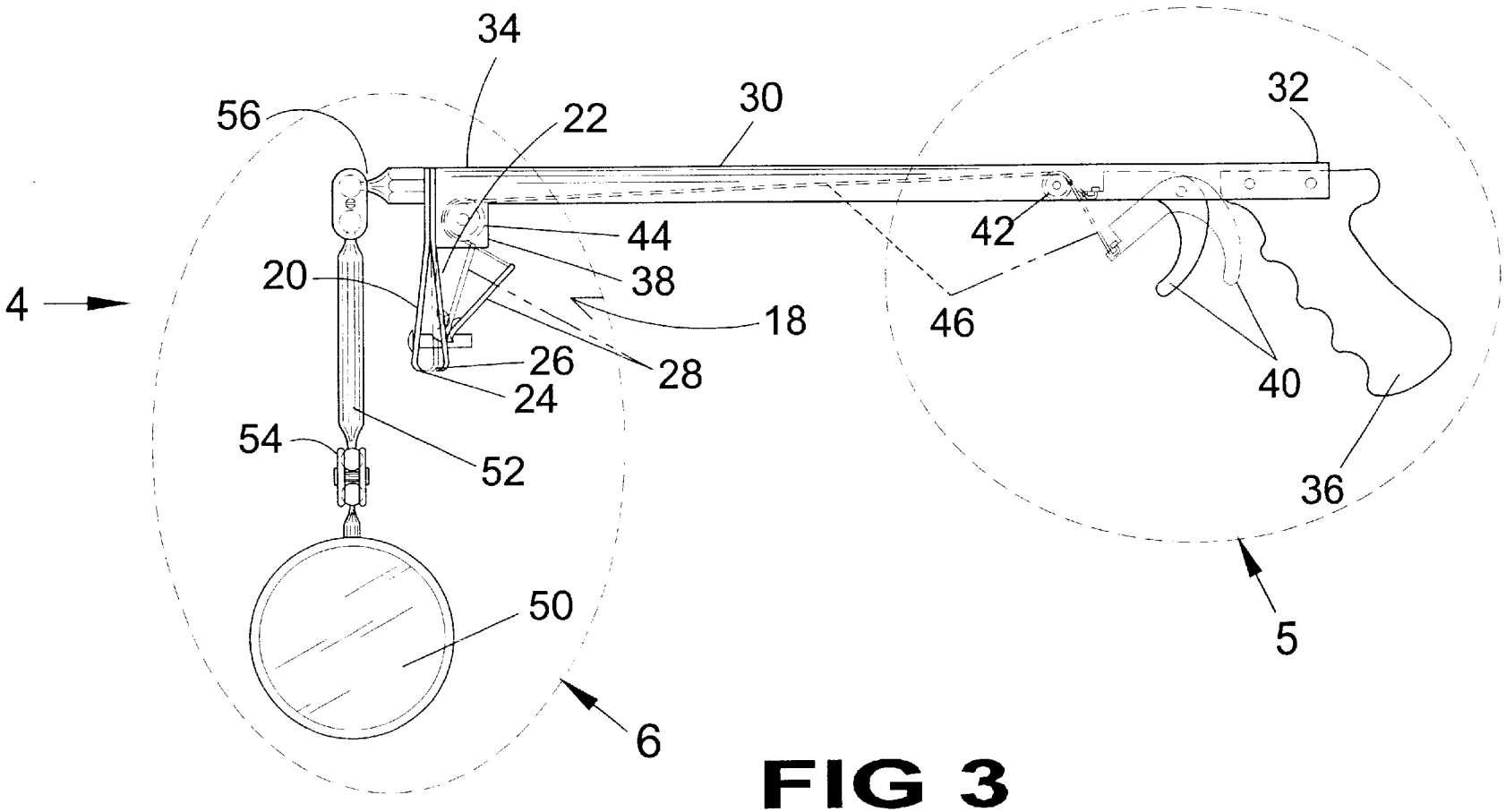
FIG. 3 is a side view of the present invention with the activated position of the trigger assembly and the clipper assembly shown in phantom line.
Figure 6:
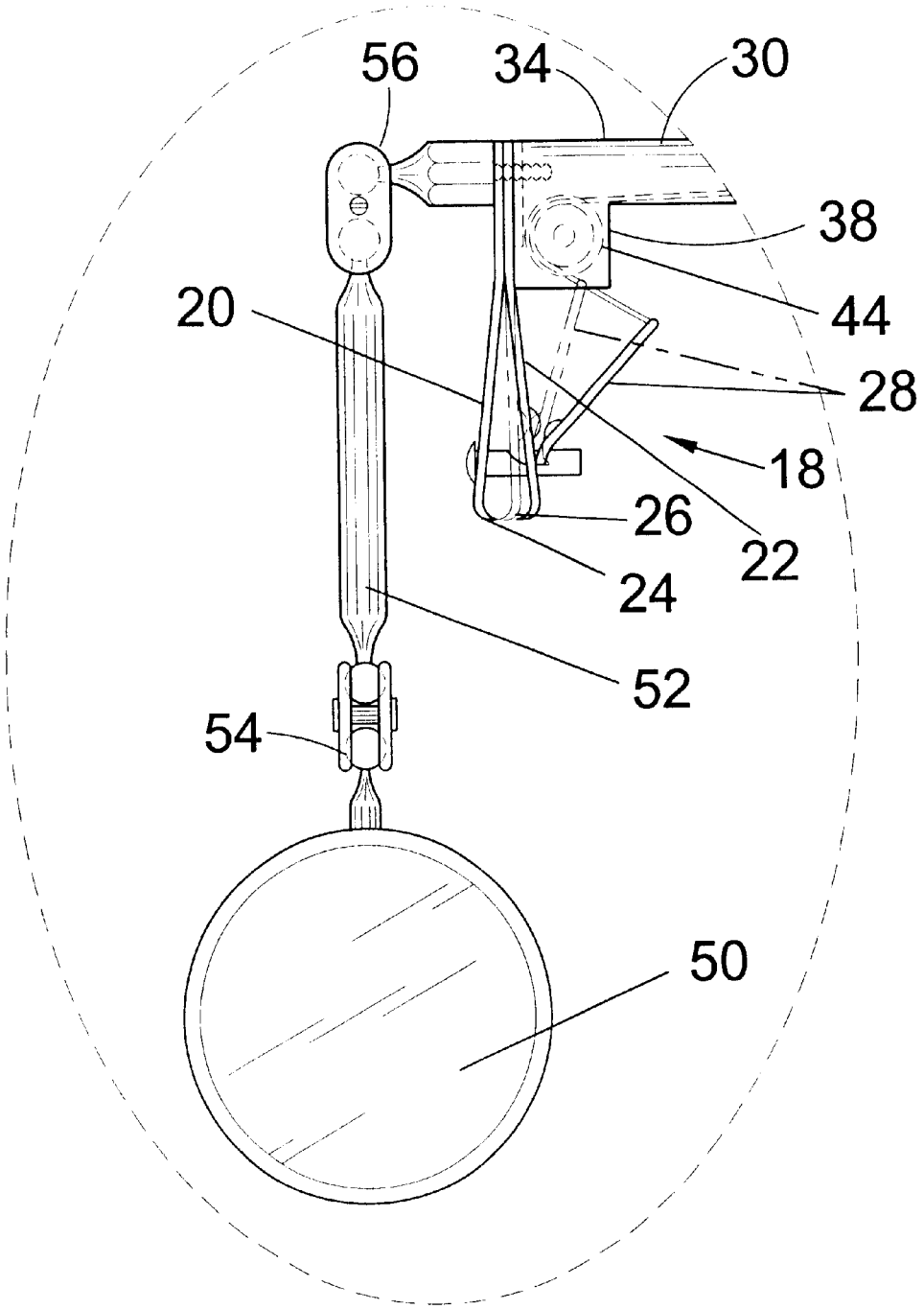
FIG. 6 is a closer view of the mirror assembly and the clipper assembly taken from FIG. 3 as indicated.

As shown in FIGS. 2–3 and 6, a nail clipper assembly 18 has two spring members 20,22 that are joined together at one end, and each spring member 20,22 has a cutting jaw 24,26. A lever 28 is provided, and when moved the lever 28 forces the cutting jaws 24,26 together, thus cutting the toenail.

An elongated body in the form of an extension shaft 30 has a first end 32 and a second end 34, as shown in FIGS. 2–3. To the first end 32 is attached a pistol grip handle 36. The nail clipper assembly 18 is attached to the extension shaft 30 at the extension shaft second end 34. The extension shaft 30 has an enlargement in the form of a compartment 38.

Pivotably attached to the extension shaft 30 near the pistol grip handle 36 is an actuating trigger mechanism 40. The trigger mechanism 40 is positioned for manipulation from a first to a second position by the user 12 gripping the pistol grip handle 38.

As shown in FIG. 3, a first roller 42 is positioned proximate the trigger mechanism 40 and a second roller 44 positioned proximate the nail clipper assembly 18, and further positioned substantially within the compartment 38. From a side view, and in the plane of the rollers 42,44 and the movement of the nail clipper assembly lever 28, it is shown in FIG. 3, that the second roller's 44 size and lower position relative to the first roller 42, cause a cord 46 to exit the second roller 44 with an approach to the lever 28, such that the angle formed by the cord 46 and the lever 28 is less than 90 degrees. In fact, the angle is approaching 90 degrees, thus optimizing the ability of the cord 46 to move the lever 28. Furthermore, as the lever 28 moves the angle changes toward the ninety degree optimum, unlike prior art devices such as that of U.S. Pat. No. 5,357,677, issued to J. W. West. In the West device the cord approach to the lever forms an obtuse angle and moves away from the ninety degree optimum as the lever is moved.

In the present invention, the cord 28 runs between the trigger mechanism 40, over the first roller 42 and over the specially sized and compartmentally placed second roller 44 where the cord 28 begins the approach to the lever 28, to which it is secured. At the other end the cord 28 is secured to the trigger mechanism 40 such that the cord 28 is pulled when the trigger mechanism 40 is squeezed, thus moving the lever 28 and closing the cutting jaws 24,26 as discussed above. FIG. 3 depicts the two positions of the trigger mechanism 40, the lever 28, and the cutting jaws 24,26, at the outset and conclusion of the squeezing of the trigger mechanism 40.

Figure 4:
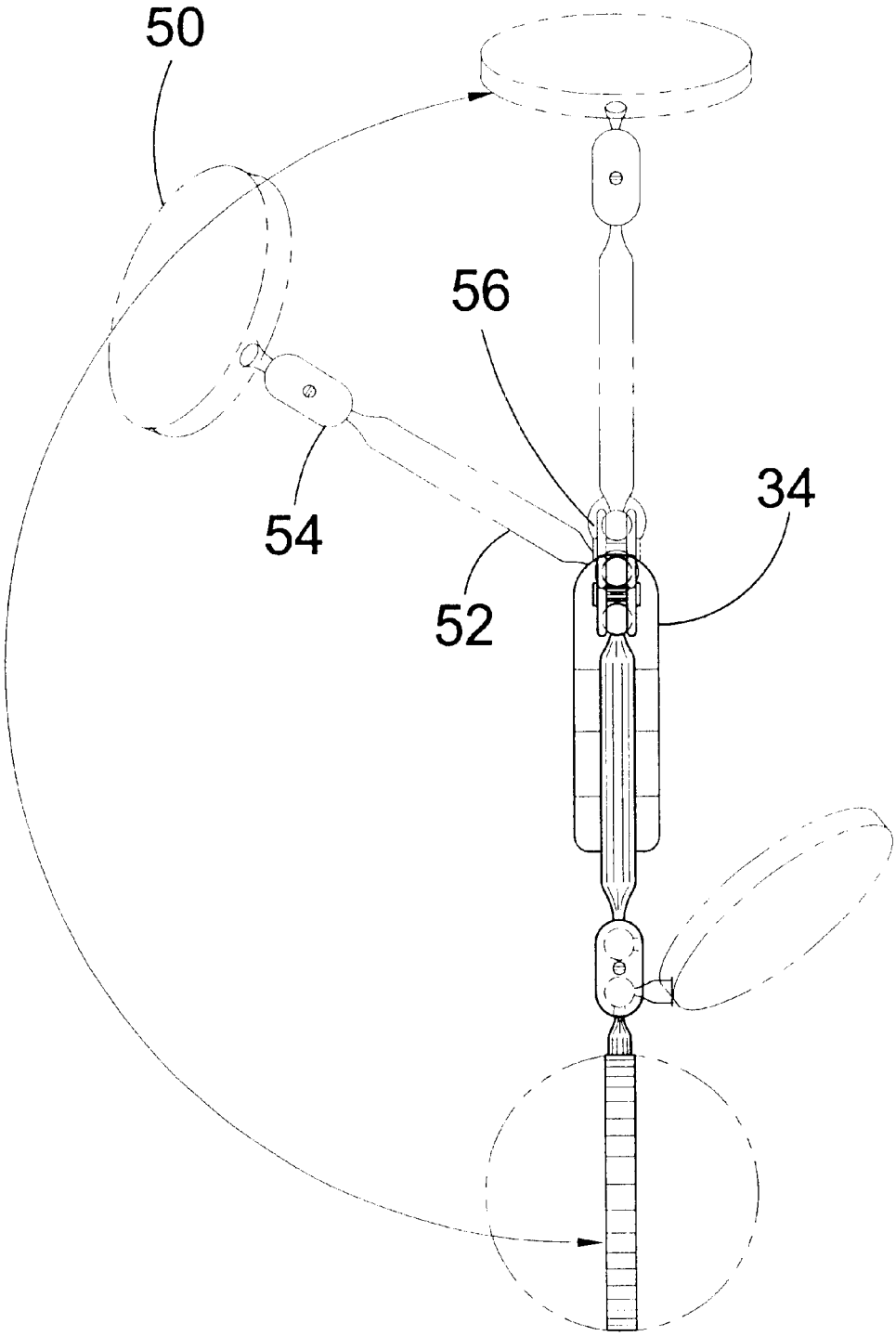
FIG. 4 is a front view of the present invention taken from FIG. 3 as indicated demonstrating some of the possible mirror assembly positions as shown in phantom line.
Figure 5:
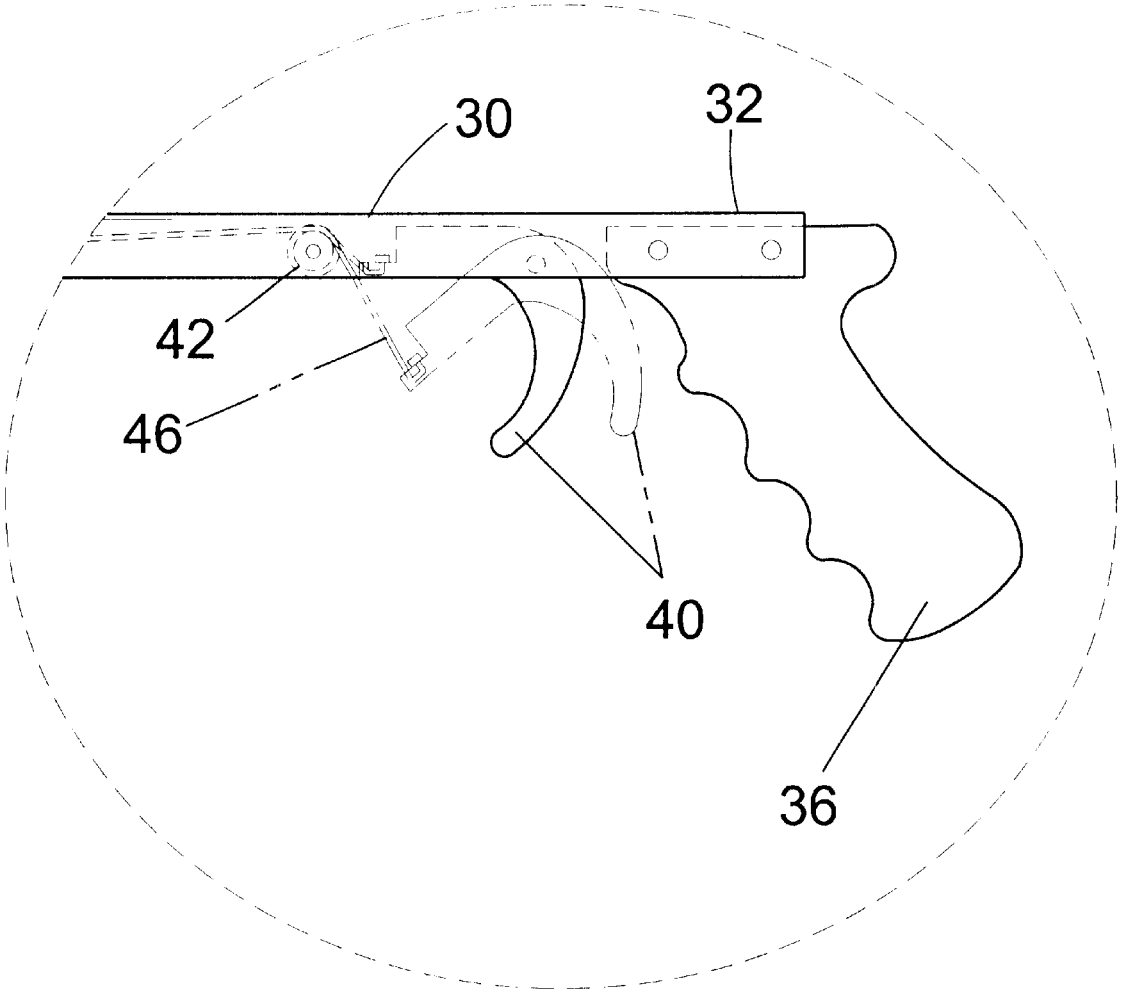
FIG. 5 is a closer view of the trigger assembly and handle taken from FIG. 3 as indicated.

As shown in FIGS. 1–4 and 6, and particularly FIG. 4, a special viewing mirror 50 is positionally and rotatably attached to the device 10 providing a full 360 degree coverage of the area of operation. The mirror 50 is attached to a mirror extension arm 52 using a first double ball joint 54. In turn, the mirror extension arm 52 is attached to the extension shaft second end 34 using a second ball joint 56. The combination of the first and second double ball joints 54,56 provide complete rotational and pivotal capabilities, enabling the user 12 to have the proper view of the toe 16 from almost any position.

Although the combination of the double ball joints 54,56 have been chosen for this preferred embodiment, other combinations of hinges, single ball joints and/or double ball joints could also be used, all in accordance with the present invention, and as determined by the intended end use for the overall device 10, as will occur to those of skill in the art upon review of the present disclosure.

In using the device 10, the user 16 first positions the nail clipper assembly 18 near the toe 16 for an assessment of the current position of the mirror 50. If the mirror 50 position is unsatisfactory, the user 12 can manipulate the mirror 50 and extension arm 52 about either or both of the first and second double ball joints 54,56 until a satisfactory mirror 50 is obtained.

With the mirror 50 appropriately adjusted, the nail clipper assembly 18 is positioned proximate the toe 16 and the user 12 grasps the pistol grip handle 36. Using the mirror 50 to ensure a proper approach, the user 12 guides the cutting jaws 24,26 into position about the toenail and squeezes the trigger mechanism 40. This actuates the cord 46 and rollers 42,44 combination resulting in a pull being exerted on the nail clipper assembly lever 28. As the lever 28 is pulled the cutting jaws 24,26 are pressed against the toenail and the cut is completed.

It will be understood that each of the elements described above, or two or more together may also find a useful application in other applications differing from that described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A toenail clipping device comprising:

an elongated body, the elongated body having a first end and a second end, the elongated body further having an enlargement proximate the elongated body second end;

a pistol grip handle on the elongated body first end;

a nail clipping assembly on the elongated body second end, having two spring members, joined together at first ends of the spring members and connected to the elongated body at the joined first ends, and having two cutting jaws biased apart on second ends of the spring members, and a lever for moving the two jaws together for cutting a nail;

an actuating trigger connected to the elongated body by a pivotal connection proximate the pistol grip handle;

a cord extending over a first and second roller and connected between the trigger and the lever, the first roller being positioned proximate the actuating trigger, the second roller being positioned in the elongated body enlargement, the first and second roller being so positioned for moving the lever toward the two spring members, thus moving the two cutter jaws on the spring levers together when the trigger is rotated around the pivotal connection toward the pistol grip handle; and a mirror assembly, the mirror assembly having a mirror and an extension arm, the mirror being movably attached to the extension arm, the extension arm being movably attached to the elongated body.

2. The device of claim 1, further comprising a hinge joint for attaching the extension arm to the mirror.

3. The device of claim 1, further comprising a ball joint for attaching the extension arm to the mirror.

4. The device of claim 1, further comprising a double ball joint for attaching the extension arm to the mirror.

5. The device of claim 1, further comprising a hinge joint for attaching the extension arm to the elongated body.

6. The device of claim 1, further comprising a ball joint for attaching the extension arm to the elongated body.

7. The device of claim 1, further comprising a double ball joint for attaching the extension arm to the elongated body.

8. The device of claim 1, further comprising a double ball joint for attaching the extension arm to the elongated body, and a double ball joint for attaching the extension arm to the mirror.

9. A toenail clipping device comprising:

an elongated body, the elongated body having a first end and a second end;

a pistol grip handle on the elongated body first end;

a nail clipping assembly on the elongated body second end, having two spring members, joined together at first ends of the spring members and connected to the elongated body at the joined first ends, and having two cutting jaws biased apart on second ends of the spring members, and a lever for moving the two jaws together for cutting a nail;

an actuating trigger connected to the elongated body by a pivotal connection 1proximate the pistol grip handle, a cord connected between the trigger and the lever for moving the lever toward the two spring members, thus moving the two cutter jaws together when the trigger is rotated around the pivotal connection toward the pistol grip handle; and a mirror assembly, the mirror assembly having a mirror and an extension arm, the mirror being movably attached to the extension arm, the extension arm being movably attached to the elongated body.

10. The device of claim 9, further comprising a hinge joint for attaching the extension arm to the mirror.

11. The device of claim 9, further comprising a ball joint for attaching the extension arm to the mirror.

12. The device of claim 9, further comprising a double ball joint for attaching the extension arm to the mirror.

13. The device of claim 9, further comprising a hinge joint for attaching the extension arm to the elongated body.

14. The device of claim 9, further comprising a ball joint for attaching the extension arm to the elongated body.

15. The device of claim 9, further comprising a double ball joint for attaching the extension arm to the elongated body.

16. The device of claim 9, further comprising a double ball joint for attaching the extension arm to the elongated body, and a double ball joint for attaching the extension arm to the mirror.

17. A toenail clipping device comprising:

an elongated body, the elongated body having a first end and a second end;

a pistol grip handle on the elongated body first end;

a nail clipping assembly on the elongated body second end, having two spring members, joined together at first ends of the spring members and connected to the elongated body at the joined first ends, and having two cutting jaws biased apart on second ends of the spring members, and a lever for moving the two jaws together for cutting a nail;

an actuating trigger connected to the elongated body by a pivotal connection proximate the pistol grip handle;

a cord extending over a pair of rollers and connected between the trigger and the lever, for moving the lever toward the two spring members, thus moving the two cutter jaws on the spring levers together when the trigger is rotated around the pivotal connection toward the pistol grip handle; and a mirror assembly, the mirror assembly having a mirror and an extension arm, the mirror being movably attached to the extension arm, the extension arm being movably attached to the elongated body.

18. The device of claim 17, further comprising a hinge joint for attaching the extension arm to the mirror.

19. The device of claim 17, further comprising a ball joint for attaching the extension arm to the mirror.

20. The device of claim 17, further comprising a double ball joint for attaching the extension arm to the mirror.

21. The device of claim 17, further comprising a hinge joint for attaching the extension arm to the elongated body.

22. The device of claim 17, further comprising a ball joint for attaching the extension arm to the elongated body.

23. The device of claim 17, further comprising a double ball joint for attaching the extension arm to the elongated body.

24. The device of claim 17, further comprising a double ball joint for attaching the extension arm to the elongated body, and a double ball joint for attaching the extension arm to the mirror.

25. A toenail clipping device comprising:

an elongated body, the elongated body having a first end and a second end;

a pistol grip handle on the elongated body first end;

a lever;

means for clipping nails in response to movement of the lever;

an actuating trigger connected to the elongated body by a pivotal connection proximate the pistol grip handle;

means for moving the lever when the trigger is rotated around the pivotal connection toward the pistol grip handle; and a mirror and means for positioning the mirror for viewing the position and operation of the nail clipping assembly.

26. The device of claim 25, wherein the means for positioning the mirror provides rotatable and pivotable positioning.

27. A toenail clipping device comprising:

an elongated body, the elongated body having a first end and a second end;

a pistol grip handle on the elongated body first end;

a nail clipping assembly on the elongated body second end, having two spring members, joined together at first ends of the spring members and connected to the elongated body at the joined first ends, and having two cutting jaws biased apart on second ends of the spring members, and a lever for moving the two jaws together for cutting a nail, an actuating trigger connected to the elongated body by a pivotal connection proximate the pistol grip handle;

means for moving the two cutter jaws on the spring levers together when the trigger is rotated around the pivotal connection toward the pistol grip handle;

a mirror; and means for rotatably and pivotably positioning a mirror for viewing the position and operation of the nail clipping assembly.

28. A toenail clipping device comprising:

an elongated body, the elongated body having a first end and a second end, the elongated body further having an enlargement proximate the elongated body second end;

a pistol grip handle on the elongated body first end;

a nail clipping assembly on the elongated.body second end, having two spring members, joined together at first ends of the spring members and connected to the elongated body at the joined first ends, and having two cutting jaws biased apart on second ends of the spring members, and a lever for moving the two jaws together for cutting a nail;

an actuating trigger connected to the elongated body by a pivotal connection proximate the pistol grip handle;

a cord extending over a first and second roller and connected between the trigger and the lever, the first roller being positioned proximate the actuating trigger, the second roller being positioned proximate the nail clipping assembly, the first and second roller being so positioned for moving the lever toward the two spring members, thus moving the two cutter jaws on the spring levers together when the trigger is rotated around the pivotal connection toward the pistol grip handle, the second roller being further positioned and sized such that the cord and the lever form an acute angle prior to such movement of the lever; and a mirror assembly, the mirror assembly having a mirror and an extension arm, the mirror being movably attached to the extension arm, the extension arm being movably attached to the elongated body.

* * * * *